US009988952B2

(12) United States Patent
Hoglund et al.

(10) Patent No.: US 9,988,952 B2
(45) Date of Patent: Jun. 5, 2018

(54) COMBUSTION ENGINE

(71) Applicant: FREEVALVE AB, Angelholm (SE)

(72) Inventors: Anders Hoglund, Munka Liungby (SE); Urban Carlson, Helsingborg (SE); Christian Von Koenigsegg, Vejbystrand (SE)

(73) Assignee: FREEVALVE AB, Angelholm (SE)

( * ) Notice: Subject to any disclaimer, the term of this patent is extended or adjusted under 35 U.S.C. 154(b) by 224 days.

(21) Appl. No.: 15/029,851

(22) PCT Filed: Oct. 8, 2014

(86) PCT No.: PCT/SE2014/051186
§ 371 (c)(1),
(2) Date: Apr. 15, 2016

(87) PCT Pub. No.: WO2015/057132
PCT Pub. Date: Apr. 23, 2015

(65) Prior Publication Data

US 2016/0230618 A1 Aug. 11, 2016

(30) Foreign Application Priority Data

Oct. 16, 2013 (SE) ..... 1351229

(51) Int. Cl.
*F01L 9/02* (2006.01)
*F02F 1/24* (2006.01)
*F01K 5/02* (2006.01)

(52) U.S. Cl.
CPC *F01L 9/02* (2013.01); *F01K 5/02* (2013.01); *F01L 9/026* (2013.01); *F02F 1/24* (2013.01)

(58) Field of Classification Search
CPC ..... F01L 9/02; F01L 9/026; F02F 1/24; F01K 5/02

(Continued)

(56) References Cited

U.S. PATENT DOCUMENTS 8,424,499 B2 * 4/2013 Rioli ..... F01L 1/465 123/90.14

FOREIGN PATENT DOCUMENTS

DE 1 159 690 B 12/1963
EP 0 328 195 A2 8/1989

OTHER PUBLICATIONS

International Search Report, dated Feb. 17, 2015, from corresponding PCT Application.

* cited by examiner

*Primary Examiner* — Ching Chang
(74) *Attorney, Agent, or Firm* — Young & Thompson

(57) ABSTRACT

A combustion engine includes a cylinder head including a controllable engine valve configured to open/close a combustion chamber in the combustion engine, a valve actuator operatively connected with and configured to displace the engine valve, and a closed pressure fluid circuit, wherein the valve actuator is arranged in the closed pressure fluid circuit. The combustion engine includes a cylinder head chamber that is included in the closed pressure fluid circuit and that is delimited by the cylinder head and a cylinder head mantle, by the valve actuator including a pneumatic pressure fluid circuit with an outlet opening that is in fluid communication with the cylinder head chamber, and by the cylinder head chamber including a hydraulic liquid drainage valve, wherein a drainage conduit stretches from the hydraulic liquid drainage valve to a hydraulic liquid vessel of the combustion engine for draining hydraulic liquid accumulated in the cylinder head chamber.

19 Claims, 5 Drawing Sheets

(58) Field of Classification Search
USPC ..... 123/90.11, 90.12, 90.13, 90.14
See application file for complete search history.

COMBUSTION ENGINE

TECHNICAL FIELD OF THE INVENTION

The present invention relates in general to a combustion engine suitable for powering a vehicle, such as a car or a truck, a boat etc. or a machine such as an electric power generation unit or the like. The combustion engines concerned are camshaft free piston engines, which are also known under the concept "engines with free valves". The present invention relates in particular to a combustion engine comprising a cylinder head that comprises a controllable engine valve configured to open/close a combustion chamber included in the combustion engine, a valve actuator that is operatively connected with and configured to displace said engine valve, and a closed pressure fluid circuit, wherein said valve actuator is arranged in said closed pressure fluid circuit.

BACKGROUND OF THE INVENTION AND STATE OF THE ART

In a camshaft free combustion engine a pressure fluid, such as a liquid or a gas, is used to achieve a displacement/opening of one or more engine valves. This means that the camshafts, and related equipment, that conventional combustion engines use to open engine valves to let air in respective let exhaust fumes out from the combustion chamber, has been replaced by a less volume demanding and more controllable system.

In an engine that is constructed for significant angular momentum outputs, the pressure in the combustion chamber is increasing proportional to an increased angular momentum output, and the force that is required to open the valve actuator to open the, in relation to the combustion chamber inward opening, engine valve consequently also increases proportional to an increased angular momentum output. At high numbers of revolutions, such as 6-8000 rpm, a very fast opening of the engine valve is also required for the filling of air respective evacuation of exhaust fumes from the engine cylinder not to be restricted. These requirements, i.e. the need for an extremely fast opening at high frequencies in a high performance engine having high counter pressure in the combustion chamber of the engine at the opening of the exhaust valves, require the pressure of the pressure fluid upstream of the valve actuator to be high, in the order of 8-30 bar.

Downstream the valve actuator, the pressure fluid has a lower pressure, in the order of 3-6 bar, and when the pressure of the pressure fluid shall be increased by way of a compressor from the low pressure downstream of the valve actuator to the high pressure upstream of the valve actuator, a temperature rise occurs that increases concurrently with an increased pressure condition.

The valve actuator employs both pneumatics and hydraulics for its operation, and in valve actuator solutions, the risk is great that gas and hydraulic fluid is mixed due to the sealing between the different fluids is not one-hundred-percent tight, and with time there is a risk that the fluids will influence each other negatively.

Further, it can be a problem that the hydraulic liquid pressure that is present in the conventional oil system of the engine is not always sufficient for the hydraulics in a valve actuator to function appropriately as the valve actuator generate rapid motions with a high frequency, and if the pressure of the pressure fluid is greater than the pressure of the hydraulic liquid, the pressure fluid will enter and mix with the hydraulic liquid.

BRIEF DESCRIPTION OF THE OBJECT OF THE INVENTION

The aim of the present invention is to set aside the abovementioned drawbacks and shortcomings of the previously known combustion engines and to provide an improved combustion engine. A fundamental object of the invention is to provide an improved combustion engine of the initially defined type, which allows the pressure fluid and the hydraulic liquid to be mixed without a negative influence on the operation of the combustion engine.

A further object of the present invention is to provide a combustion engine that achieves an automatic lubrication of mechanical components arranged in connection with the closed pressure fluid circuit.

It is another object of the present invention to provide a combustion engine that achieves a cooling of the pressure fluid.

BRIEF DESCRIPTION OF THE FEATURES OF THE INVENTION

According to the invention, the main object is at least achieved by way of the initially defined combustion engine that has the features defined in the independent claims. Preferred embodiments of the present invention are further defined in the dependent claims.

According to the present invention, a combustion engine of the initially defined type is provided that is characterized in that the combustion engine further comprising a cylinder head chamber that is included in said closed pressure fluid circuit and that is delimited by said cylinder head and a cylinder head mantle, by the valve actuator comprising a pneumatic pressure fluid circuit configured to operate the valve actuator to displace the controllable engine valve and comprising an outlet opening for pressure fluid, which outlet opening is in fluid communication with said cylinder head chamber, and by the cylinder head chamber comprising a hydraulic liquid drainage valve, wherein a drainage conduit extends from the hydraulic liquid drainage valve to a hydraulic liquid trough of the combustion engine for draining away hydraulic liquid accumulated in the cylinder head chamber.

The present invention is thus based on the insight that in those cases a controlled and very limited leakage/supply of hydraulic liquid to the pressure fluid occurs in the valve actuator, or at another place in the closed pressure fluid circuit, a hydraulic liquid trap is achieved by the hydraulic liquid enriched pressurized air from the valve actuator being emptied in a cylinder head chamber where a surplus of hydraulic liquid in the pressure fluid is accumulated and drained away in a controlled manner. Positive effects are thus achieved, such as cooling of the pressure fluid and lubrication of movable mechanical components arranged in connection with the closed pressure fluid circuit, without risking that the hydraulic liquid enriched pressure fluid causes problems with the operation of the combustion engine.

According to a preferred embodiment of the present invention, the cylinder head comprises an upper surface that constitutes a bottom surface of the cylinder head chamber, wherein the hydraulic liquid drainage valve is arranged in a recess in the upper surface. This way, it is guaranteed that the pressure fluid is not allowed to escape when the hydraulic liquid drainage valve is open, without a certain amount of hydraulic liquid always being present in said recess above the hydraulic liquid drainage valve.

According to a preferred embodiment, the combustion engine comprises a pressure increase pump situated between a hydraulic liquid manifold, which is connected to a hydraulic circuit of the valve actuator, and a hydraulic liquid pump of the combustion engine. This means that hydraulic liquid is always fed with a sufficient pressure to the valve actuator, irrespective of the pressure that is generated by the ordinary hydraulic liquid pump of the combustion engine.

In a further preferred embodiment, the hydraulic liquid manifold comprises a non-return valve arranged between the pressure increase pump and the valve actuator, which non-return valve is configured to allow a flow in the direction toward the valve actuator. This way, it is guaranteed that pressure fluid is not pressed into the hydraulic liquid when the combustion engine is turned off.

Preferably, the hydraulic liquid manifold comprises a pressure balancing element. The pressure balancing element means that the rapid changes in the flow in the hydraulic liquid manifold that comes from the operation of a valve actuator does not generate oscillations or cavitation of the hydraulic liquid in the hydraulic liquid manifold that risk disturbing the operation of the other valve actuators.

Further advantages with and features of the invention are evident from the remaining dependent claims and from the following detailed description of preferred embodiments.

BRIEF DESCRIPTION OF THE DRAWINGS

A more thorough understanding of the abovementioned and other features and advantages of the present invention will be evident from the following detailed description of preferred embodiments with reference to the enclosed drawings, on which.

DETAILED DESCRIPTION OF PREFERRED EMBODIMENTS

Figure 1:
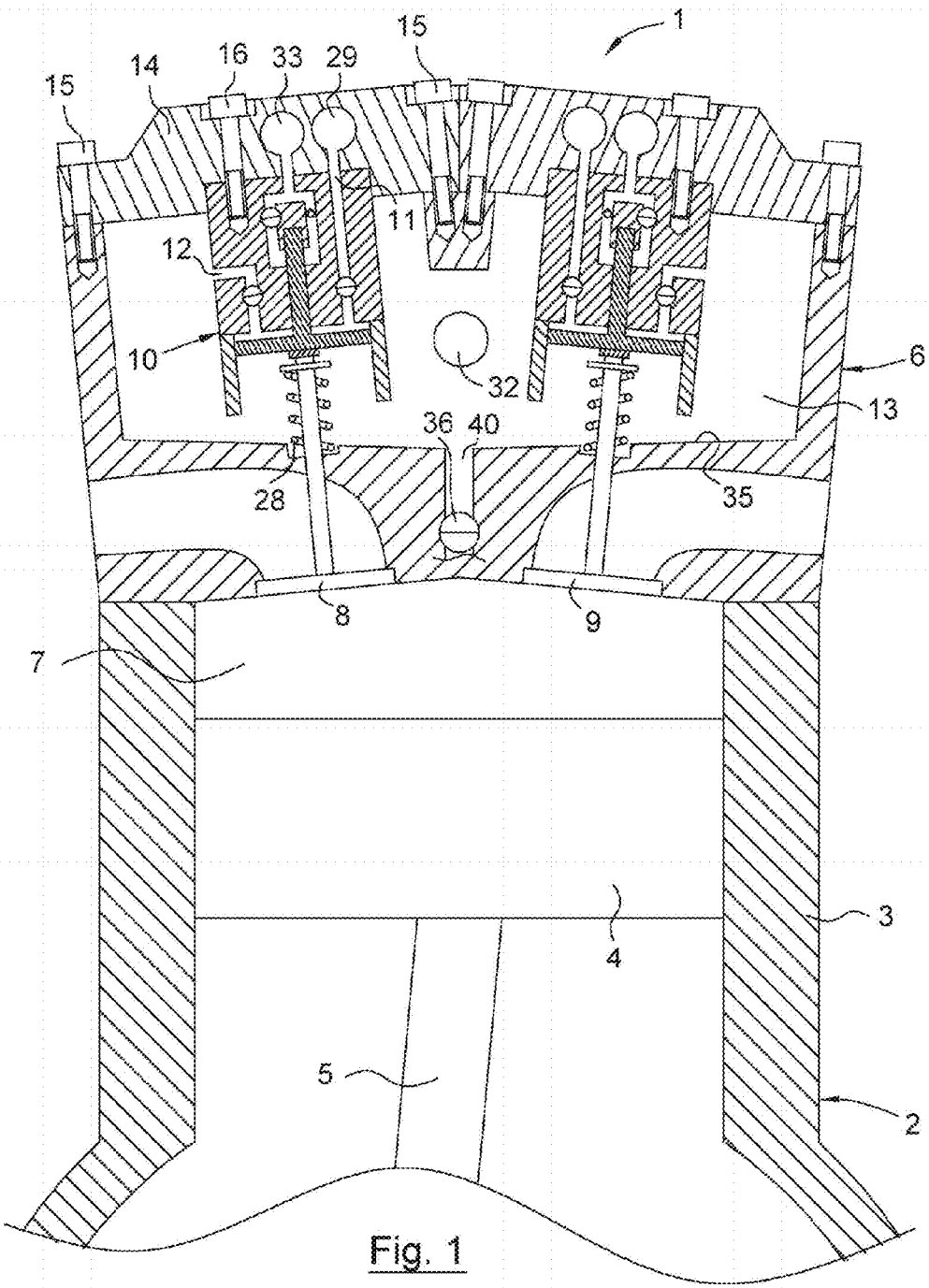
FIG. 1 is a schematic cross-sectional side view of a part of a combustion engine.

Reference is initially made to FIG. 1 that is a schematic depiction of a part of an inventive combustion engine, generally denoted 1. The combustion engine 1 comprises a cylinder block 2 with at least one cylinder 3. Said cylinder block 2 generally comprises three or four cylinders 3. In the shown embodiment reference is made only to one cylinder 3, it should nevertheless be realized that he equipment described below in relation to the shown cylinder 3 is preferably applied to all of the cylinders of the combustion engine 1, in the embodiment the combustion engine comprises more cylinders.

Furthermore, the combustion engine 1 comprises a piston 4 that is axially displaceable in said cylinder 3. The movement, axial displacement back and forth, of the piston 4 is transferred on a conventional manner to a connection rod 5 connected with the piston 4, the connection rod 5 in turn is connected to and drives a crank shaft (not shown) in rotation.

The combustion engine 1 also comprises a cylinder head 6 that together with said cylinder 3 and said piston 4 delimits a combustion chamber 7. In the combustion chamber 7 the ignition of a mix of fuel and air occurs in a conventional manner and is not further described herein. The cylinder head 6 comprises at least one controllable first engine valve 8, also known as a gas exchange valve. In the shown embodiment, the cylinder head also comprises a controllable second engine valve 9. The one engine valve 8 constitutes, in the shown embodiment, an inlet valve that is arranged to selectively open/close for supply of air to the combustion chamber 7, and the second engine valve 9 constitutes in the shown embodiment an air outlet valve, or exhaust valve, that is arranged to selectively open/close for evacuation of exhausts form the combustion chamber 7.

The combustion engine 1 further comprises a first valve actuator, generally denoted 10, that is operatively connected to said first engine valve 8 and that is arranged in a closed pressure fluid circuit of the combustion engine 1. The valve actuator 10 comprises a pneumatic pressure fluid circuit with at least one inlet opening 11 for pressure fluid and at least one outlet opening 12 for pressure fluid. The pressure fluid is a gas or a gas mixture, preferably air or nitrogen gas. Air has the advantage that it is easy to change the pressure fluid or to supply more pressure fluid if the closed pressure fluid circuit leaks, and nitrogen gas has the advantage that it lacks oxygen, which prevents oxidation of other elements.

In the case the combustion engine comprises several valve actuators are these arranged in parallel to one another in said closed pressure fluid circuit. Each valve actuator can be operatively connected with one or more engine valves, the combustion engine can for example comprise two air inlet valves 8, which are jointly driven by the same valve actuator 10. Nevertheless, it is preferred that each valve actuator operates one engine valve each to achieve the greatest possible controllability of the operation of the combustion engine 1.

The description below of the combustion engine will only include one engine valve 8 and one valve actuator 10, but it should be realized that the corresponding also applies to all engine valves and valve actuators if nothing else is said.

The combustion engine 1 also comprises a cylinder head chamber 13 that forms part in said closed pressure fluid circuit and that is delimited by said cylinder head 6 and at least a first cylinder head mantle 14. In the shown embodiment, the cylinder head mantle 14 is divided in two parts, which are individually attachable to and releasable from the cylinder head 6 by way of bolts. The cylinder head chamber 13 preferably presents a volume in the order of 3-10 liter, typically in the order of 5-6 liter. In an alternative embodiment, only a cylinder head mantle 14 is present that, together with the cylinder head 6, delimits the cylinder head chamber 13.

The at least one outlet opening 12 of the valve actuator 10 is in fluid communication with the cylinder head chamber 13, i.e. that the pressure fluid leaving the valve actuator 10 via said at least one outlet opening 12 flows out in the cylinder head chamber 13. In those cases where the combustion engine 1 comprises several valve actuators, all outlet openings of the valve actuators for pressure fluid discharge in the same cylinder head chamber.

Preferably, the whole of the valve actuator 10 is arranged in said cylinder head chamber 13, and it is also preferred that the valve actuator 10 is releasably connected to said cylinder head mantle 14, for example by a bolt 16, or similar holding means. In this embodiment, the valve actuator 10 accordingly "hangs" in the cylinder head mantle 14 without being in contact with the cylinder head 6. If the valve actuator 10 should be in contact with both the cylinder head mantle 14 and the cylinder head 6, a construction wise disadvantageous tolerance chain is achieved.

Figure 2:
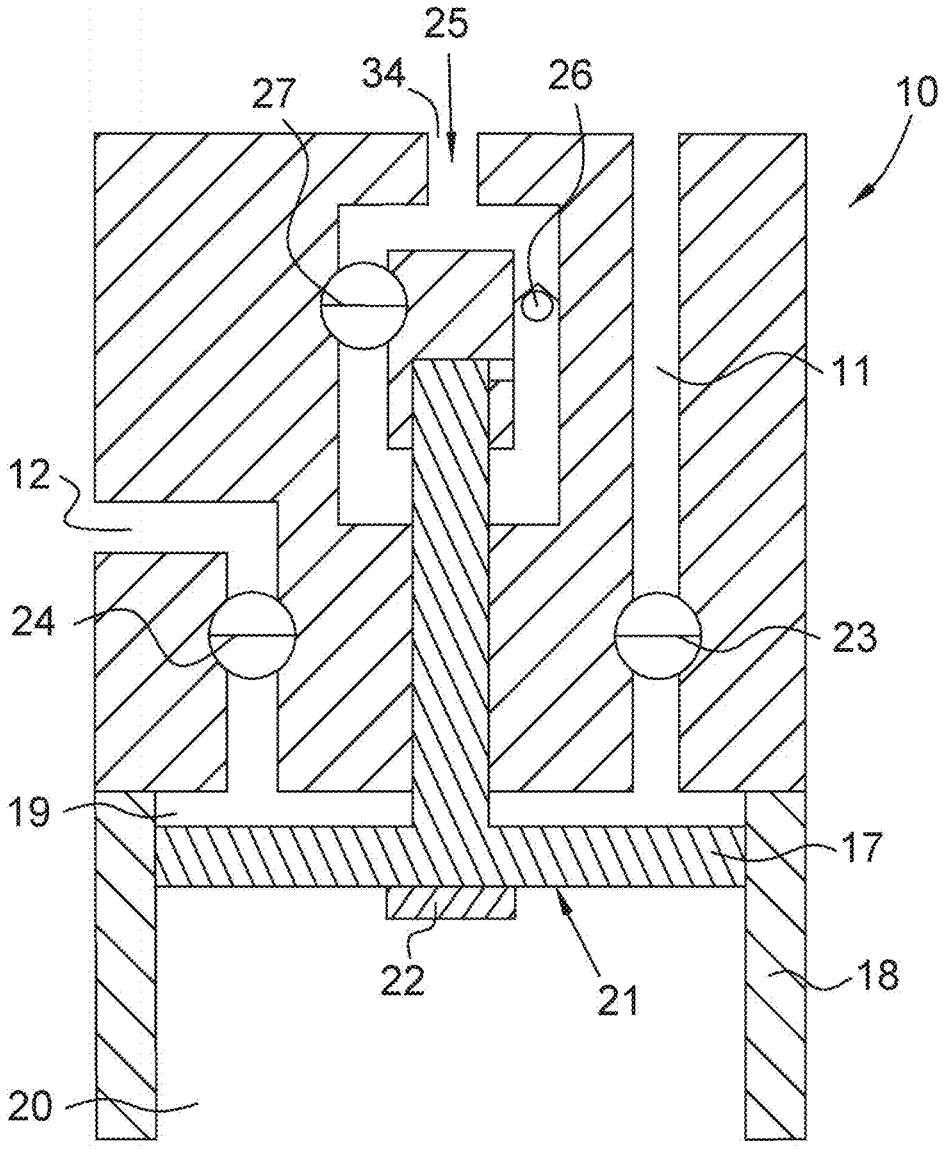
FIG. 2 is a schematic cross-sectional side view of a valve actuator.

Reference is now made to FIG. 2, which shows a schematic depiction of the valve actuator 10.

The valve actuator 10 comprises an actuator piston disc 17 and an actuator cylinder 21 delimiting a downward open cylinder volume. The actuator piston disc 17 divides said cylinder volume in a first upper part 19 and a second lower part 20 and is axially displaceable in said actuator cylinder 21. The actuator piston disc 17 forms part of an actuator piston, generally denoted 21, that is arranged to contact and drive said first engine valve 8. The actuator piston further comprises means 22 for play elimination in axial direction in relation to said first engine valve 8. The play eliminating means 22 are preferably hydraulic, and assures that when the actuator piston disc 21 is in its upper turn position, the actuator piston 21 remains in contact with the first engine valve 8 when it is closed, for the purpose of correcting for assembly tolerances, heat expansion, etc. Accordingly, the axial length of the actuator piston 21 is adjusted by way of the play eliminating means 22.

The other part 20 of the cylinder volume of the valve actuator 10 is in fluid communication with said cylinder head chamber 13. This way, it is guaranteed that the same pressure acts on the actuator piston disc 17 from the first part 19 of the cylinder volume respective from the second part 20 of the cylinder volume when the actuator piston 21 is in the upper turn position. Thereby, the sealing between the actuator piston disc 17 and the actuator cylinder 12 is not critical, and some leakage can be allowed for minimizing the resistance to displacement of the actuator piston disc 17, and in resting position, the actuator piston disc is not affected by changes in the low pressure level.

The valve actuator 10 comprises a controllable inlet valve 23 that is arranged to open/close the inlet opening 12, a controllable outlet valve 27 that is arranged to open/close the outlet opening 11, a hydraulic circuit, generally denoted 25, that in turn comprises a non-return valve 26 arranged to allow filling of the hydraulic circuit 25, and a controllable emptying valve 27 arranged to control the emptying of the hydraulic circuit 25. It should be pointed out that the valves in the valve actuator 10 are schematically depicted and can for example be constituted by sliding valves, seat valves, etc. Furthermore, several of the abovementioned controllable valves may be constituted by a single body. Each valve can further be directly or indirectly electrically controlled. With directly electrically controlled is meant that the position of the valve is directly controlled by, for example, an electromagnetic device, and with indirect electrically controlled is meant that the position of the valve is controlled by a pressure fluid that in turn is controlled by, for example, an electro-magnetic device.

To achieve a displacement of the actuator piston disc 17 downward for opening the engine valve 8, the inlet valve 26 is opened to allow a filling of pressure fluid with a high pressure in the upper part 19 of the cylinder volume. When the actuator piston 21 is displaced downward, the non-return valve 26 of the hydraulic circuit 25 opens, whereupon hydraulic liquid is sucked in and replaces the volume that the actuator piston 21 leaves. Thereafter, the inlet valve 23 is closed and the pressure fluid that has entered in the upper part 19 of the cylinder volume is allowed to expand, whereupon the actuator piston disc 17 continues its movement downwards. When the pressure fluid in the upper part 19 of the cylinder volume is not able to displace the actuator piston disc 17 further, i.e. when the pressure on the under side of the actuator piston disc 17 and the return spring 28 of the engine valve 8 is as high as the pressure on the upper side of the actuator piston disc 17, the actuator piston disc 17 stops. The actuator piston disc 17 is held (locked) in its lower position a desired amount of time by keeping the emptying valve 27 of the hydraulic circuit 25 closed at the same time as the non-return valve 26 of the hydraulic circuit 25 is automatically closed. To achieve a return movement, the outlet valve 24 is opened to allow an evacuation of pressure fluid from the upper part 19 of the cylinder volume, and additionally the emptying valve 27 of the hydraulic circuit 25 is opened, whereupon the actuator piston disc is displaced upward when the hydraulic liquid is evacuated from the hydraulic circuit 25, and at the same time, the pressure fluid is evacuated from the upper part 17 of the cylinder volume to the cylinder head chamber 13.

Figure 3:
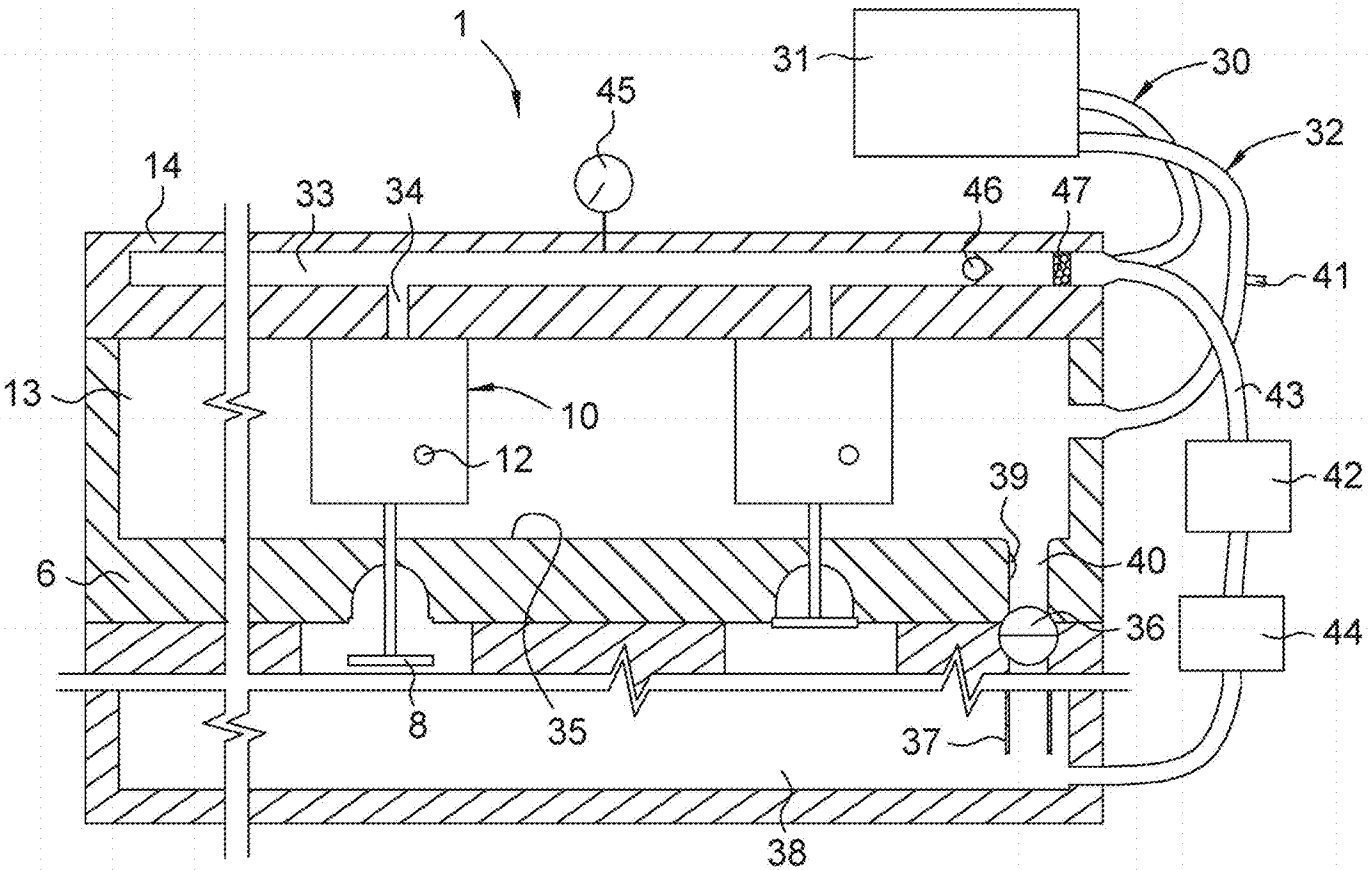
FIG. 3 is a schematic cross-sectional side view of a part of a combustion engine, viewed from the side in relation to FIG. 1.
Figure 4:
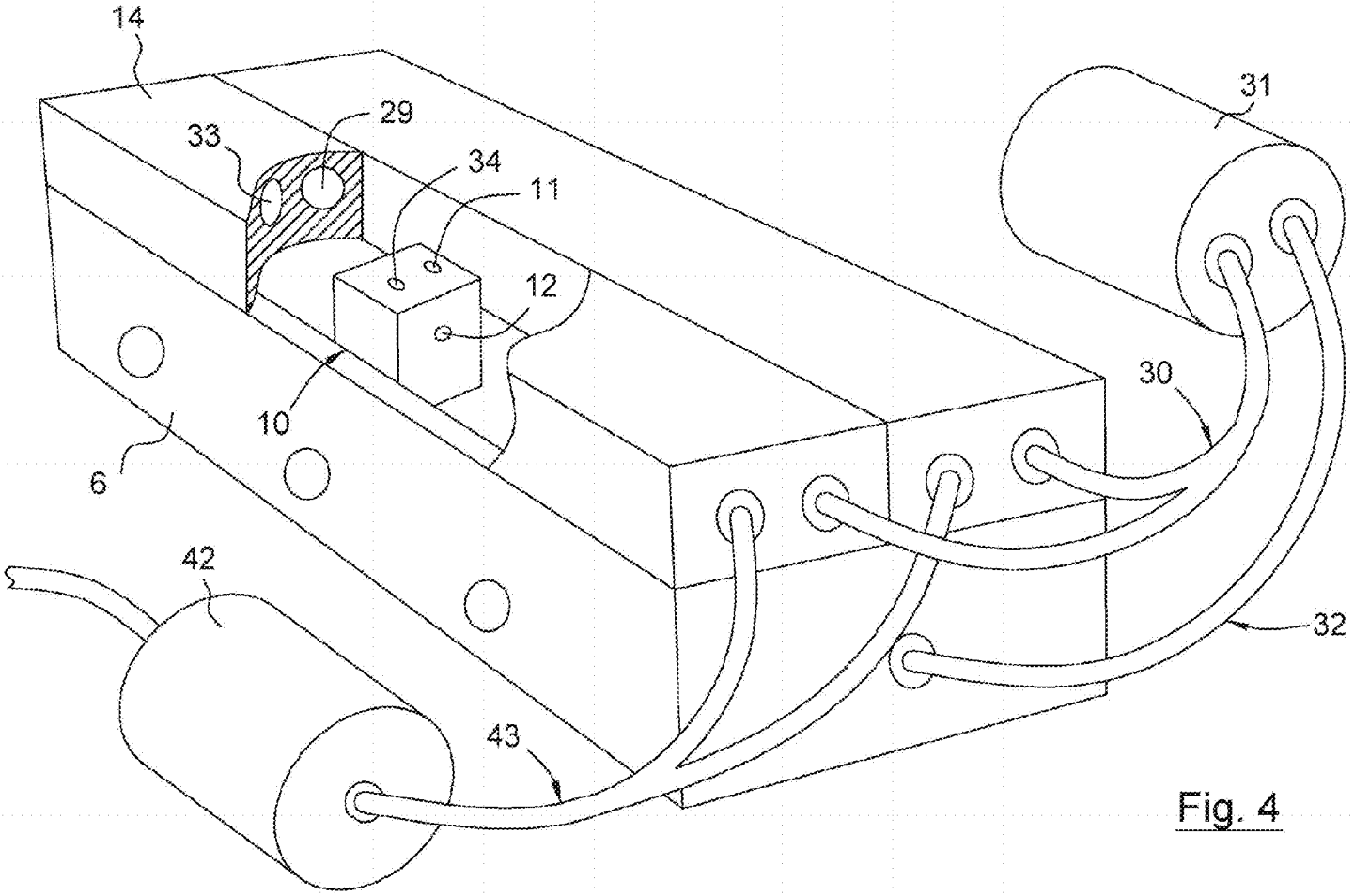
FIG. 4 is a partly cross-sectional schematic perspective view of a cylinder head and cylinder head mantles.

Reference is now made primarily to FIG. 3, which shows a partly cross-sectional schematic perspective view of, among other things, a cylinder head and cylinder head mantles.

The cylinder head mantle 14 comprises a pressure fluid manifold 29 that is connected to the at least one inlet opening 11 of the valve actuator 10. The pressure fluid manifold 29 extends along the axial length of the cylinder head mantle 14. Said pressure fluid manifold 29 forms part of a primary pressure fluid channel 30 that extends from a compressor 31 to the at least one inlet opening 11 of the valve actuator 10. The compressor 31 is arranged to supply a pressure fluid under high pressure to the valve actuators. Furthermore, a secondary pressure fluid channel 32 (see also FIG. 1) extends from the cylinder head chamber 13 to said compressor 31.

The volume of the primary pressure fluid channel 30, high pressure side, shall be kept as small as possible so that the temperature of the pressure fluid will sink as little as possible from the compressor 31 to the valve actuator 10. The volume of the cylinder head chamber 13 and the secondary pressure fluid channel 32, low pressure side, shall on the other hand be maximized so that the pressure ratio between the low pressure side and the high pressure side is affected as little as possible when the compressor 31 pulls gas/pressure fluid from the low pressure side. Preferably, the volume of the cylinder head chamber 13 and the secondary pressure fluid channel 32 is at least ten times greater than the volume of the primary pressure fluid channel 30, most preferably at least 15 times greater.

The compressor 31 has variable compressor volume/displacement, or by other means adjustable outflow, and generally the compressor 31 is driven by the crank shaft of the combustion engine 1. At high numbers of revolutions and high torque output, higher pressure of the pressure fluid in the primary pressure fluid channel 30 is required, and at low numbers of revolutions and low torque output, lower pressure of the pressure fluid in the primary pressure fluid channel 30 is required.

The pressure level on the high pressure side in the order of 8-30 bar to, with sufficient speed, open an inward opening engine valve where a high counter pressure is present in the combustion chamber, and the pressure level on the low pressure side is in the order of 4-8 bar, to achieve a pressure ratio below 1:4, preferably below 1:3. The aim is to hold the temperature of the pressure fluid in the primary pressure fluid channel 30 below 120° C. under normal operation for avoiding oxidizing a hydraulic fluid mist that is present in the pressure fluid, however temperatures up to 150° C. can be allowed for short periods.

The cylinder head mantle 14 further comprises a hydraulic liquid manifold 33 that is connected with an inlet opening 34 of said hydraulic circuit 25 of the valve actuator 10. The hydraulic liquid manifold 33 extends along the axial length of the cylinder head mantle 14, parallel with the pressure fluid manifold 29. The first cylinder head mantle 14 further comprises all necessary electric infrastructure (not shown) for, among other things, controlling the first valve actuator 10, for various sensors, etc.

The valve actuator 10 employs pneumatics as well as hydraulics for its operation, and during operation of the valve actuator 10, hydraulic liquid from the hydraulic circuit 25 is allowed to, in a controlled and very limited manner, leak over to the gas in the pressure fluid circuit of the valve actuator 10. The hydraulic liquid and the gas forms an aerosol, or pressure fluid with a hydraulic liquid mist, that is emptied out via the outlet opening 12 in the cylinder head chamber 13. The hydraulic liquid mist result in positive effects, such as lubrication of the valve actuator 10 and the compressor 31, and cooling of the pressure fluid. The hydraulic liquid is preferably oil, and most preferably the hydraulic liquid is constituted by the normal engine oil of the combustion engine 1.

When the pressure fluid in the cylinder head chamber 13 is saturated, a portion of the hydraulic liquid will form drops that are collected on an upper surface 35 of the cylinder head 6, which upper surface 35 constitutes a bottom surface of the cylinder head chamber 13. The cylinder head chamber 13 comprises a hydraulic liquid drainage valve 36 that is configured to, via a drainage conduit 37 extending from the hydraulic liquid drainage valve 36 to a hydraulic liquid vessel 38 of the combustion engine 1, drain away superfluous hydraulic from the cylinder head chamber 13. The hydraulic liquid drainage valve 36 is arranged in the upper surface 35 of the cylinder head 6.

The hydraulic liquid drainage valve 36 is preferably electrically controlled, and thereto biased to a drainage conduit 37 closing position for the purpose of guaranteeing that the hydraulic liquid drainage valve 36 is closed if anything in the control fails, to prevent pressure fluid from escaping. A hydraulic liquid level sensor 39 is arranged in the cylinder head chamber 13 and operatively connected to said hydraulic liquid drainage valve 36. The hydraulic liquid level sensor 39 can be directly operatively connected to the hydraulic liquid drainage valve 36 for forming a so-called autonomous unit, or be indirectly operatively connected with the hydraulic liquid drainage valve 36 via a control unit (not shown) that preferably is constituted by an engine control unit or a valve actuator control unit. The hydraulic liquid level sensor 39 should preferably open the hydraulic liquid drainage valve 36 at a predetermined hydraulic liquid level and close the hydraulic liquid drainage valve 36 at another predetermined hydraulic liquid level. Alternatively, the hydraulic liquid level sensor 39 may open the hydraulic liquid drainage valve 36 at a predetermined hydraulic liquid level and close after a predetermined time.

In a preferred embodiment, the hydraulic liquid drainage valve 36 is situated in a recess 40 in the upper surface 35 of the cylinder head 6. Most preferably, the hydraulic liquid drainage valve 36 is situated at least four centimeters under said upper surface 35, and additionally the hydraulic liquid level sensor 39 is preferably situated between the hydraulic liquid drainage valve 36 and the upper surface 35 of the cylinder head 6, wherein hydraulic liquid should always be present above the hydraulic liquid drainage valve 36 to ensure that the pressure liquid should not escape via the hydraulic liquid drainage valve 36 when it is open. Preferably, the upper surface 35 of the cylinder head 6 is slanting downward towards the hydraulic liquid drainage valve 36. Further, the secondary pressure fluid channel discharges in the cylinder head chamber 13 at a level above the upper surface of the cylinder head 6 to ensure that liquid hydraulic liquid is not pulled along to the compressor 31.

To ensure that a sufficient amount of hydraulic liquid mist is present in the pressure fluid that arrives at the compressor 31 to provide a sufficient lubrication of the compressor 31, the combustion engine 1 may comprise a spray nozzle 41 arranged to supply hydraulic liquid to the pressure fluid, which spray nozzle 41 is arranged in said secondary pressure fluid channel 32, or in connection with the inlet of the compressor 31. According to a first embodiment, the spray nozzle 41 continuously provides hydraulic liquid to the pressure fluid. In an alternative embodiment, hydraulic liquid is provided via a controllable spray nozzle 31 for being able to continuously optimizing the lubrication of the compressor 31 and the temperature of the pressure fluid.

Preferably, the combustion engine 1 comprises a pressure increase pump 42 situated on a conduit 43 between the hydraulic liquid manifold 33 and the hydraulic liquid vessel 38 for generating a pressure in the hydraulic liquid manifold 33 that is at least two bar greater than the pressure in the cylinder head chamber 13. Preferably, the pressure increase pump 42 is situated between the hydraulic liquid manifold 33 and a conventional oil pump 44 of the combustion engine 1. The pressure increase pump 42, also known as servo pump or booster, can be electrically controlled via an electric motor, or be mechanically controlled by way of the pressure fluid of the high pressure side or hydraulically from the engine oil pressure of the combustion engine 1. The pressure increase pump 42 may be constituted by a pump with rotating piston or a two-piston pump with a drive piston having a greater area than its pump piston.

A mechanically controlled pressure increase pump 42 is configured to pump as soon as it can, i.e. the pressure increase pump 42 pumps as soon as the outgoing pressure drops below the determined outgoing pressure that the area relation is arranged to generate, which leads to a more or less constant outgoing pressure.

An electrically controlled pressure increase pump 42 is operatively connected with a control unit, and additionally the hydraulic liquid manifold 33 comprises a pressure sensor 45 that is operatively connected with the pressure increase pump 42, to ensure that optimal pressure is present in the hydraulic liquid manifold 33.

To prevent that pressure fluid leaks from the closed pressure fluid circuit via the hydraulic liquid manifold 33 when the combustion engine 1 is turned off and the pressure increase pump 42 stop working, a non-return valve 46 is arranged between the pressure increase pump 42 and the valve actuator 10, which non-return valve 46 configured to allow a flow in the direction toward the valve actuator 10. The pressure of the hydraulic fluid between the valve actuator 10 and the non-return valve 46 drops as a result of leakage in the valve actuator 10, and when the hydraulic liquid pressure is equal to the pressure in the cylinder head chamber 13, equilibrium is achieved and the pressure fluid is prevented from leaking into the hydraulic liquid manifold 33. Further, a filter 47 can be arranged between the pressure increase pump 42 and the valve actuator 10 for preventing particles in the hydraulic liquid from entering and damaging the valve actuator 10.

Figure 5:
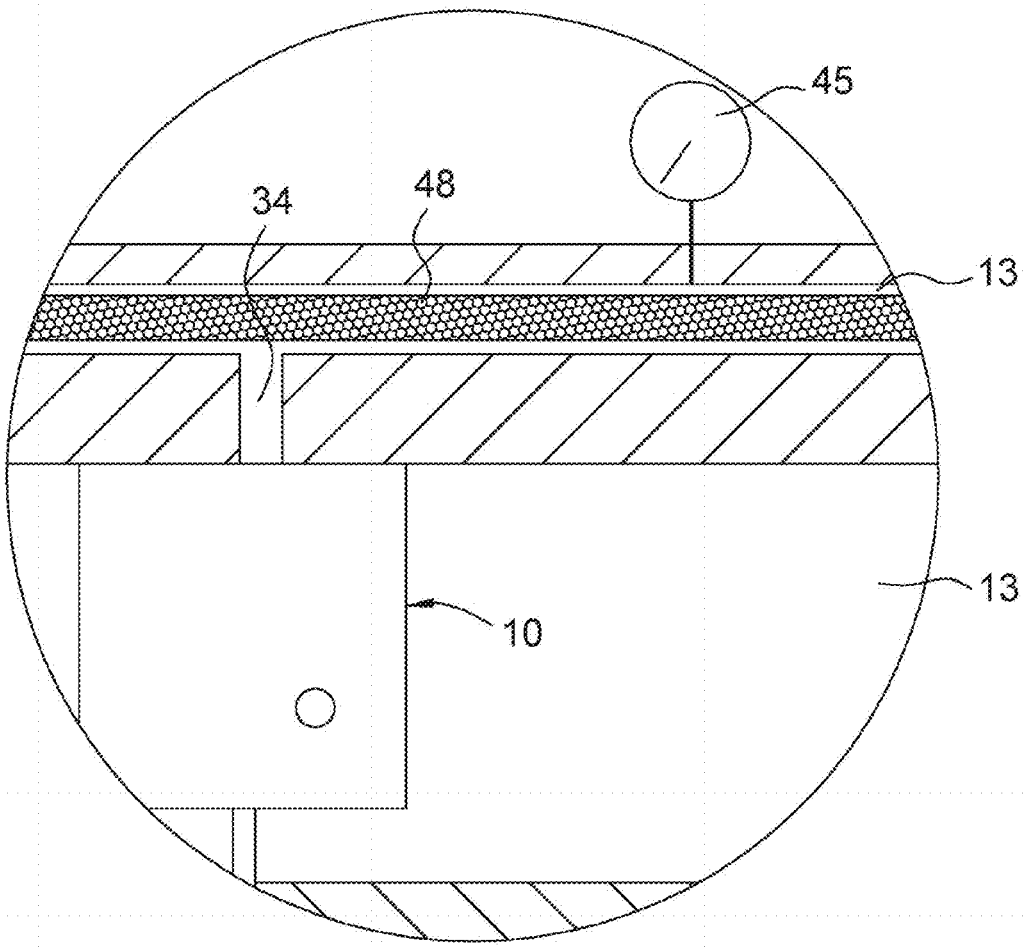
FIG. 5 is a schematic enlarged partial view of FIG. 3 showing an alternative embodiment.

Reference is now made to FIG. 5. In the shown embodiment, the hydraulic liquid manifold 33 comprises a pressure balancing element 48 that extends along the whole of or a part of the axial length of the hydraulic liquid manifold 33. The pressure balancing element 48 is used to prevent pulses originating from the inlet opening 34 of the hydraulic circuit 25 to lead to cavitation or oscillations in the hydraulic liquid in the hydraulic liquid manifold 33. The advantage of the pressure balancing element 48 extending along the whole of or a part of the axial length of the hydraulic liquid manifold 33 is that the pressure balancing element 48 is situated in direct connection with the inlet opening for hydraulic of each of the valve actuators 10.

The pressure balancing element 48 can for example be constituted by a flexible gas-filled tube or a tube of a flexible material. In the embodiment with a gas-filled tube, the tube may contain a large chamber or several smaller chambers, alternatively the gas-filled tube may contain a foam with a very large amount of gas-filled blisters. In a further alternative embodiment, a string of a porous material or flexible material may constitute the pressure balancing element 48, for example a string of neoprene or another oil resistant rubber. The advantage with several gas filled chambers or blisters is that even if a chamber/blister breaks, the overall function is minimally affected.

CONCEIVABLE MODIFICATIONS OF THE INVENTION

The invention is not limited to only the abovementioned and embodiments shown in the drawings, which only have an illustrating and exemplifying purpose. This patent application is intended to cover all modifications and variants of the preferred embodiments described herein, and the present invention is consequently defined by the wording of the enclosed claims and the equipment can thus be modified in all conceivable ways within the framework of the enclosed claims.

It should also be pointed out that all information about/concerning terms such as above, below, upper, lower, etc. shall be interpreted/read with the equipment oriented in accordance with the figures, with the drawings oriented in such a way that the reference numbers can be read in a correct manner. Consequently, such terms indicates only relative relationships in the shown embodiments, which relationships can be changed if the equipment according to the invention is provided with another construction/design.

It should be pointed out that even if it is not explicitly stated that features from a specific embodiment can be combined with the features of another embodiment, this should be regarded as obvious when so is possible.

The invention claimed is:

1. A combustion engine comprising a cylinder head (6) that comprises a controllable engine valve (8) configured to open/close a combustion chamber (7) included in the combustion engine (1), a valve actuator (10) that is operatively connected to and configured to displace said engine valve (8), and a closed pressure fluid circuit, wherein said valve actuator (10) is arranged in said closed pressure fluid circuit, said combustion engine (1) further comprising a cylinder head chamber (13) that is included in said closed pressure fluid circuit and that is delimited by said cylinder head (6) and a cylinder head mantle (14), by the valve actuator (10) comprising a pneumatic pressure fluid circuit configured to operate the valve actuator (10) to displace the controllable engine valve (8) and comprising an outlet opening (12) for pressure fluid, which outlet opening (12) is in fluid communication with said cylinder head chamber (13), and by the cylinder head chamber (13) comprising a hydraulic liquid drainage valve (36), wherein a drainage conduit (37) stretches from the hydraulic liquid drainage valve (36) to a hydraulic liquid vessel (38) of the combustion engine (1) for draining away hydraulic liquid accumulated in the cylinder head chamber (13).

2. The combustion engine according to claim 1, wherein the hydraulic liquid drainage valve (36) is electrically controlled.

3. The combustion engine according to claim 2, wherein the cylinder head chamber (13) comprises a hydraulic liquid level sensor (39), which is operatively connected with said hydraulic liquid drainage valve (36).

4. The combustion engine according to claim 1, wherein the cylinder head chamber (13) comprises a hydraulic liquid level sensor (39), which is operatively connected with said hydraulic liquid drainage valve (36).

5. The combustion engine according to claim 1, wherein the cylinder head (6) comprises an upper surface (35) that constitutes a bottom surface of the cylinder head chamber (13), wherein the hydraulic liquid drainage valve (36) is arranged in said upper surface (35).

6. The combustion engine according to claim 5, wherein the hydraulic liquid drainage valve (36) is situated in a recess (40) in the upper surface (35) of the cylinder head (6).

7. The combustion engine according to claim 6, wherein the upper surface (35) cylinder head (6) is slanting downward towards the hydraulic liquid drainage valve (36).

8. The combustion engine according to claim 5, wherein the upper surface (35) cylinder head (6) is slanting downward towards the hydraulic liquid drainage valve (36).

9. The combustion engine according to claim 5, further comprising a compressor (31) and a secondary pressure fluid channel (32) that stretches from the cylinder head chamber (13) to said compressor (31), wherein the secondary pressure fluid channel (32) discharges in the cylinder head chamber (13) at a level above the upper surface (35) of the cylinder head (6).

10. The combustion engine according to claim 9, wherein a spray nozzle (41), configured to supply hydraulic fluid to the pressure fluid, is arranged in said secondary pressure fluid channel (32).

11. The combustion engine according to claim 1, wherein the valve actuator (10) comprises a hydraulic circuit (25).

12. The combustion engine according to claim 11, wherein the cylinder head mantle (14) comprises a hydraulic liquid manifold (33) that is connected with said hydraulic circuit (25) of the valve actuator (10).

13. The combustion engine according to claim 12, further comprising a pressure increase pump (42) situated between the hydraulic liquid manifold (33) a hydraulic liquid pump (44) of the combustion engine (1).

14. The combustion engine according to claim 13, wherein the hydraulic liquid manifold (33) comprises a pressure sensor (45) that is operatively connected with the pressure increase pump (42).

15. The combustion engine according to claim 14, wherein the hydraulic liquid manifold (33) comprises a non-return valve (46) arranged between the pressure increase pump (42) and the valve actuator (10), which non-return valve is configured to allow a flow in the direction toward the valve actuator (10).

16. The combustion engine according to claim 13, wherein the hydraulic liquid manifold (33) comprises a non-return valve (46) arranged between the pressure increase pump (42) and the valve actuator (10), which non-return valve is configured to allow a flow in the direction toward the valve actuator (10).

17. The combustion engine according to claim 12, wherein the hydraulic liquid manifold (33) comprises a pressure balancing element (48).

18. The combustion engine according to claim 17, wherein the pressure balancing element (48) is constituted by a flexible gas-filled tube.

19. The combustion engine according to claim 17, wherein the pressure balancing element (48) is constituted by a string of a porous material.

* * * * *